US012569075B2

(12) United States Patent
Blum

(10) Patent No.: US 12,569,075 B2
(45) Date of Patent: Mar. 10, 2026

(54) CHILD CARRIER

(71) Applicant: John Blum, Santa Rita, GU (US)

(72) Inventor: John Blum, Santa Rita, GU (US)

( * ) Notice: Subject to any disclaimer, the term of this patent is extended or adjusted under 35 U.S.C. 154(b) by 195 days.

(21) Appl. No.: 18/392,017

(22) Filed: Dec. 21, 2023

(65) Prior Publication Data

US 2025/0204699 A1 Jun. 26, 2025

(51) Int. Cl.
*A47D 13/02* (2006.01)

(52) U.S. Cl.
CPC ..... *A47D 13/02* (2013.01)

(58) Field of Classification Search
CPC ..... A47D 13/02
USPC ..... 602/4
See application file for complete search history.

(56) References Cited

U.S. PATENT DOCUMENTS 982,376 A * 1/1911 Macfarlane ..... A47D 13/02 224/159
2,628,358 A * 2/1953 Neils ..... A47D 9/016 2/69.5
3,587,952 A * 6/1971 Higuchi ..... A47D 13/025 224/160
4,815,639 A * 3/1989 Lehman ..... A61F 5/3738 224/159
5,011,057 A * 4/1991 Perruzza ..... A47D 13/02 224/608
5,333,769 A * 8/1994 Skroski ..... A47D 5/006 5/413 R
8,418,897 B1 * 4/2013 Young ..... A61F 5/3738 224/159
8,936,314 B2 * 1/2015 Lai ..... B60N 2/2842 224/159
9,144,322 B2 * 9/2015 Gillam ..... A47D 13/029
10,561,259 B1 * 2/2020 Gaspari ..... A47G 9/109
D896,534 S * 9/2020 Page ..... D6/333
11,272,791 B2 * 3/2022 Warner ..... A47D 13/025
D967,441 S * 10/2022 Daken ..... D24/190
2010/0032460 A1 * 2/2010 Hyde ..... A47D 15/006 224/160
2010/0051658 A1 * 3/2010 Parness ..... A47D 13/02 224/625
2010/0187268 A1 7/2010 Rosen
2011/0226822 A1 9/2011 Higuchi
2022/0000275 A1 * 1/2022 Gums ..... A47D 13/02
2022/0015552 A1 1/2022 Straub

FOREIGN PATENT DOCUMENTS

GB 2506942 4/2014

* cited by examiner

*Primary Examiner* — Justin M Larson

(57) ABSTRACT

A child carrier apparatus for holding a child such as an infant near a user includes a flexible casing which houses a rigid or semirigid insert panel. The flexible casing may lie flat or may be positioned in a use configuration in which the flexible casing forms a U-shape. The insert panel lies in the base of the U-shape when the flexible casing is in the use configuration. A carrying strap is usable to hang the flexible casing on the user's shoulder and around the user's torso. A retaining fastener is operable to keep the flexible casing in the use configuration. The child may be placed atop the insert panel, and the user may help secure the child in the child carrier apparatus by placing an arm next to the child during use of the apparatus.

12 Claims, 5 Drawing Sheets

CHILD CARRIER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to child carriers and more particularly pertains to a new child carrier for holding a child such as an infant near a user.

(2) Description of Related Art Including Information Disclosed Under 37 CFR 1.97 and 1.98

The prior art relates to child carriers for facilitating a user to carry a child. Various structures are available which use a variety of structural arrangements including slings which hang on the user's shoulder. However, the prior art fails to describe such a sling arrangement for a child carrier which comprises a casing that houses a rigid or semirigid insert panel, and which may fold into a U-shape with the insert panel positioned in a base portion of the U-shape to support the child.

BRIEF SUMMARY OF THE INVENTION

An embodiment of the disclosure meets the needs presented above by generally comprising a flexible casing which comprises a plurality of fabric panels that are layered with each other and joined at their peripheral edges to form a perimeter of the flexible casing. The flexible casing has a first end and a second end. The flexible casing also comprises a first end portion adjacent to the first end, a second end portion adjacent to the second end, and a central portion which is coupled to and extends between the first end portion and the second end portion. The flexible casing is positionable in a planar configuration in which the first end portion, the second end portion, and the central portion lie on a common plane. An insert panel is positioned in the flexible casing. The insert panel has a first edge and a second edge positioned opposite each other. The first edge faces the first end of the flexible casing and the second edge faces the second end of the flexible casing when the flexible casing is positioned in the planar configuration.

The flexible casing and the insert panel are also positionable in a use configuration wherein the flexible casing forms a U-shape and the insert panel lies horizontally in a base portion of the U-shape. A carrying strap is mounted to the first end of the flexible casing and is configured to hang the flexible casing on a shoulder and across a torso of a user. A retaining fastener is engageable to retain the flexible casing in the use configuration.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
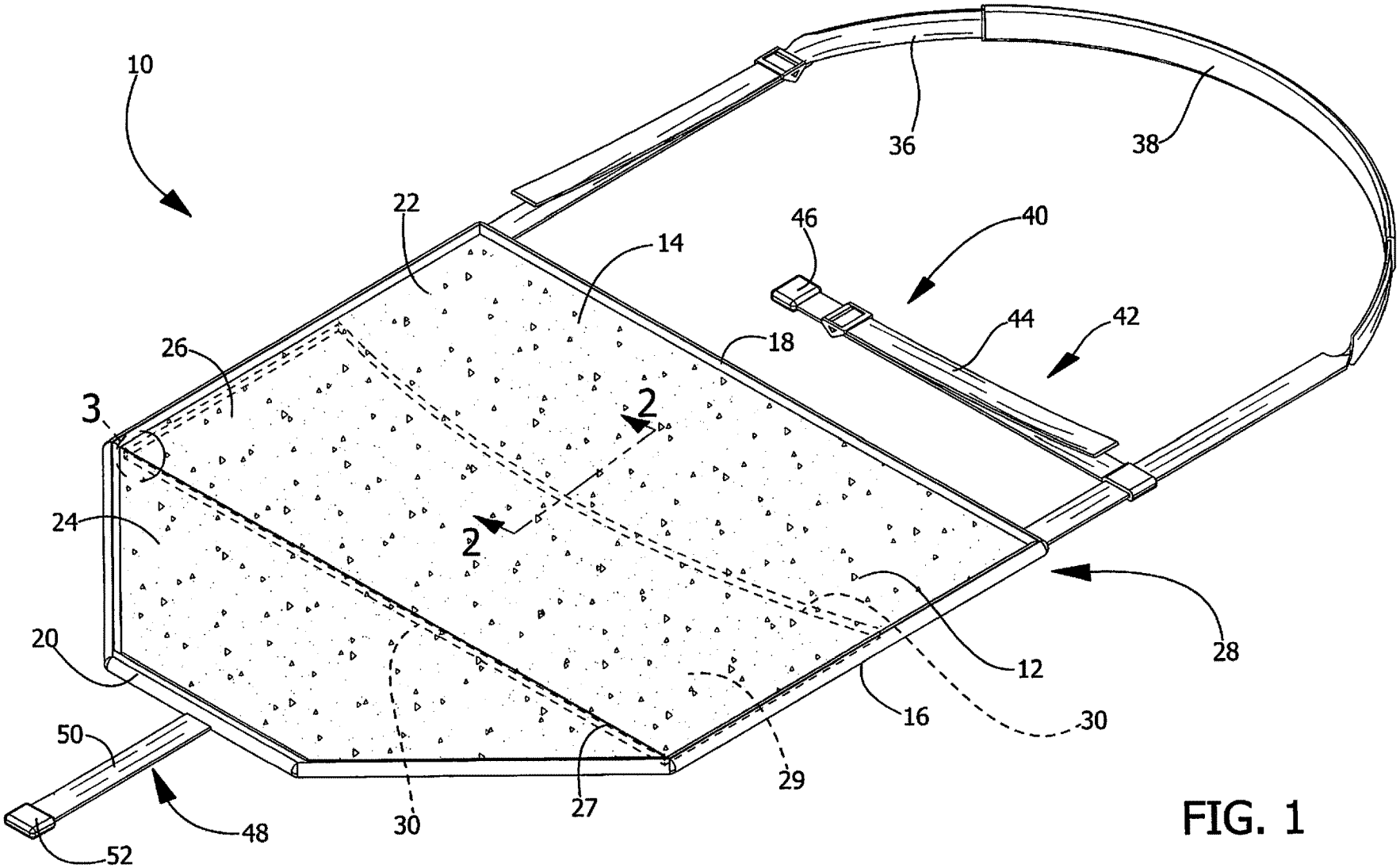
FIG. 1 is a perspective view of a child carrier apparatus according to an embodiment of the disclosure.

With reference now to the drawings, and in particular to FIGS. 1 through 5 thereof, a new child carrier embodying the principles and concepts of an embodiment of the disclosure and generally designated by the reference numeral 10 will be described.

Figure 2:
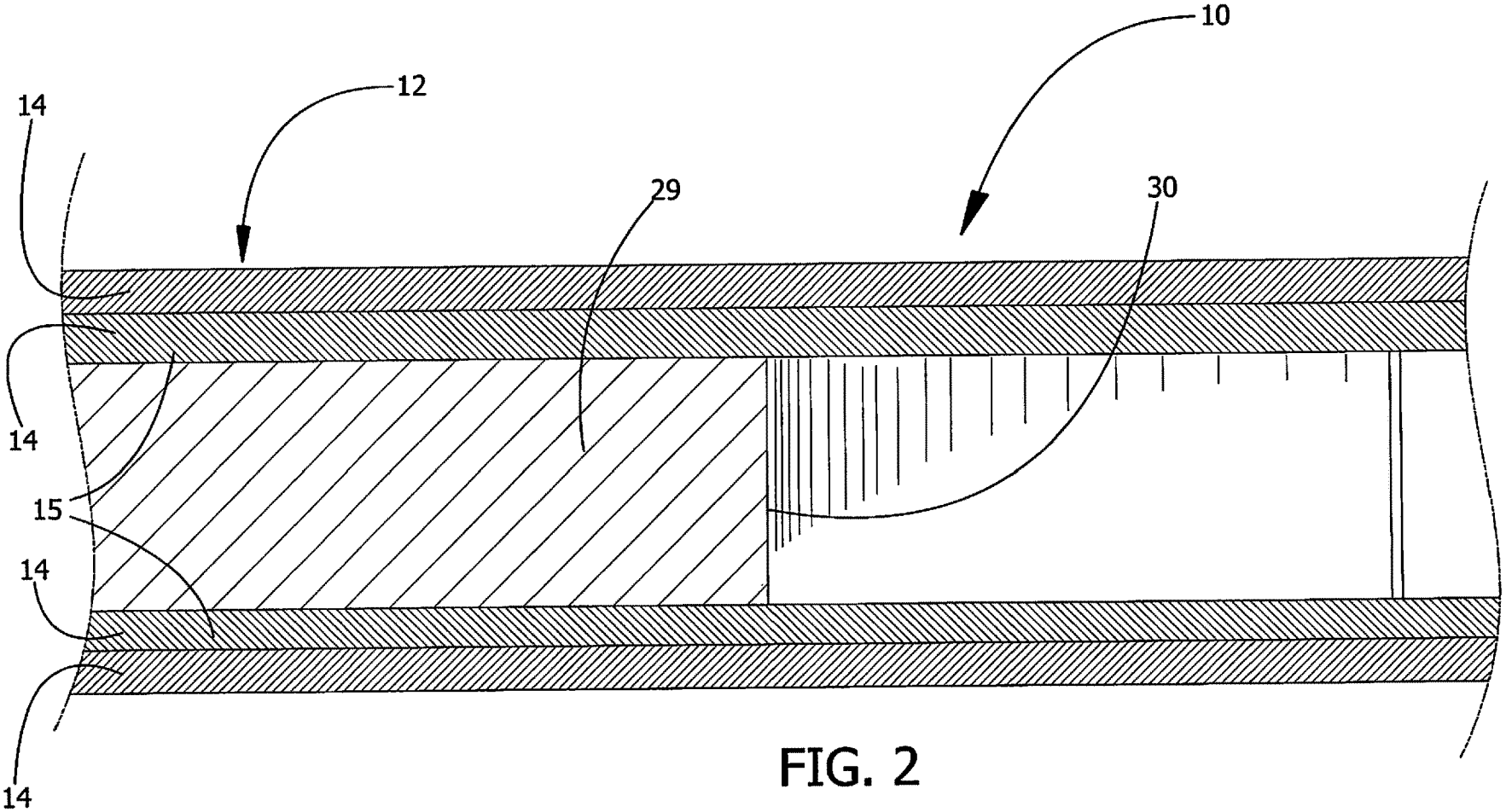
FIG. 2 is a cross-section view of an embodiment of the disclosure taken from Line 2-2 in FIG. 1.
Figure 3:
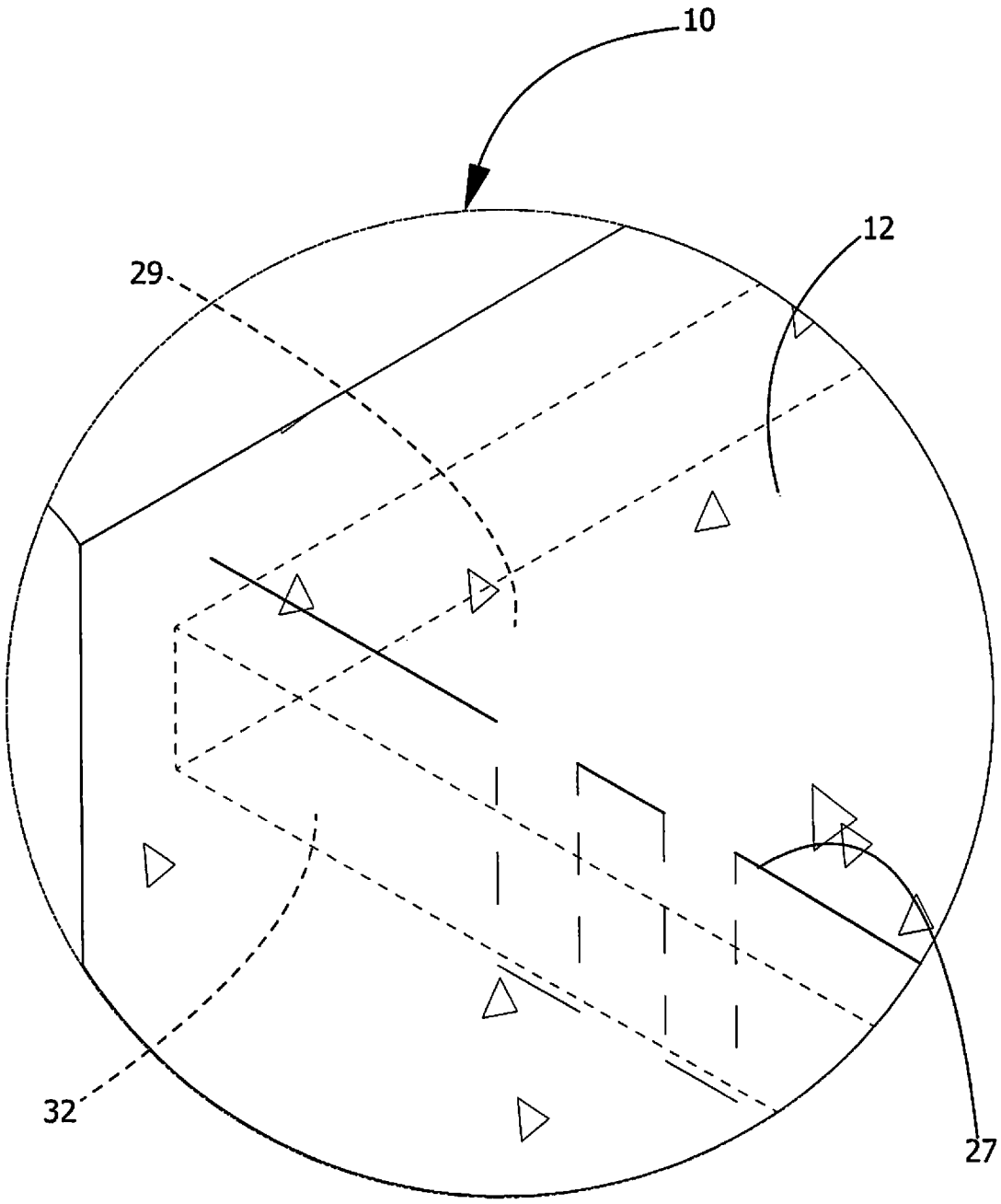
FIG. 3 is a detail view of an embodiment of the disclosure taken from Window 3 in FIG. 1.
Figure 4:
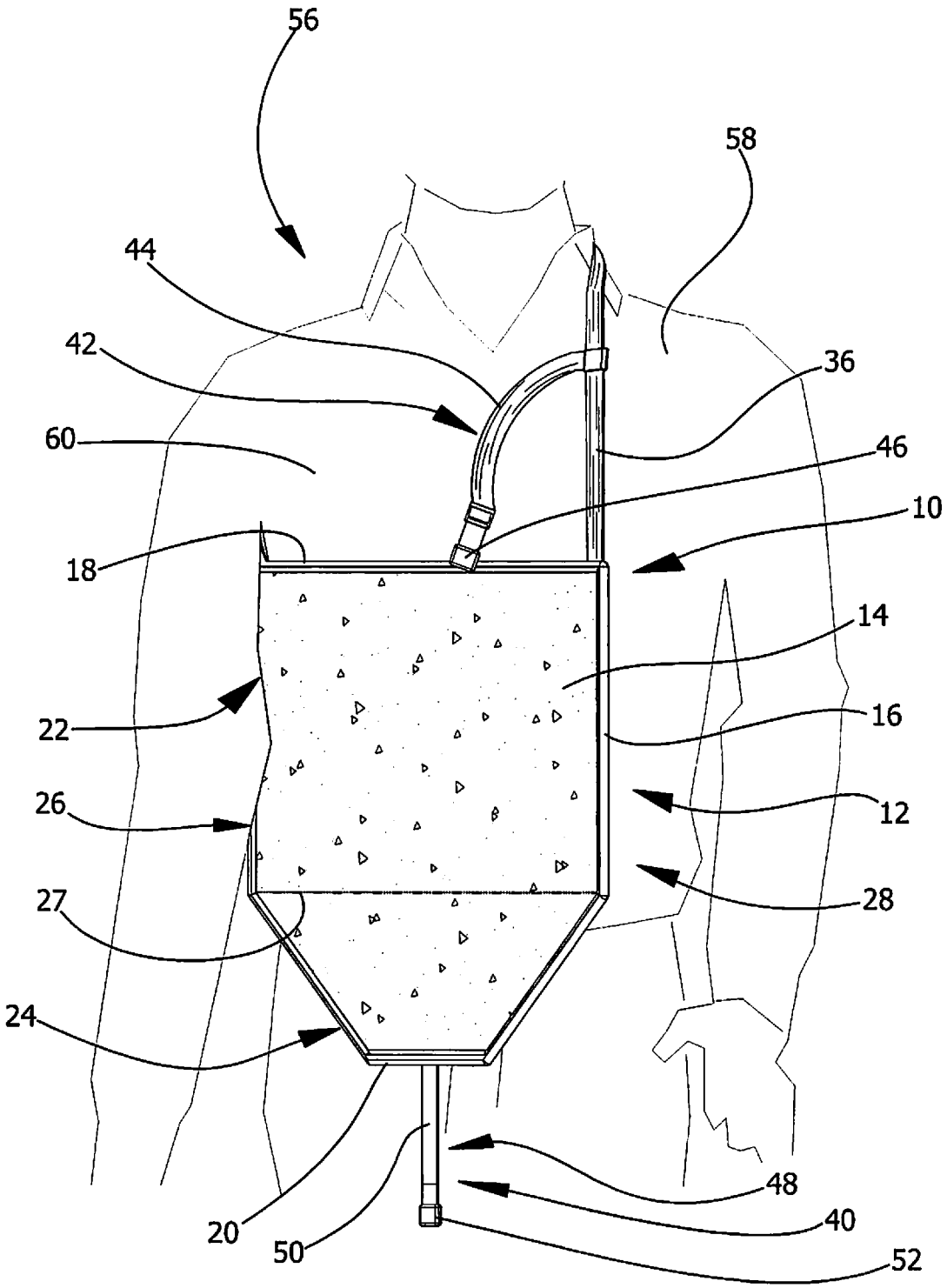
FIG. 4 is an in-use view of an embodiment of the disclosure.
Figure 5:
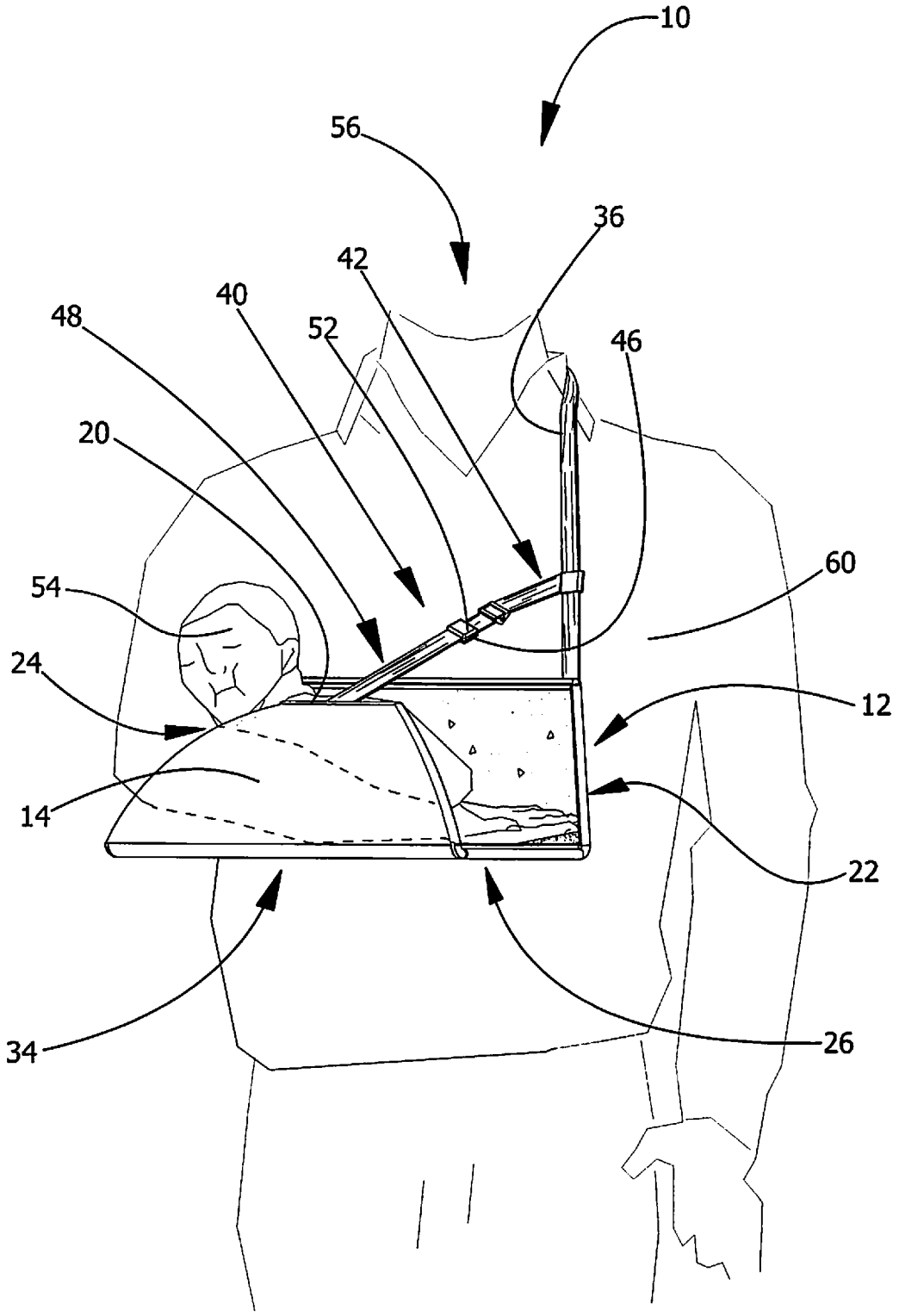
FIG. 5 is an in-use view of an embodiment of the disclosure.

As best illustrated in FIGS. 1 through 5, the child carrier apparatus 10 generally comprises a flexible casing 12 which comprises a plurality of fabric panels 14 that are layered with each other and are joined at their peripheral edges to form a perimeter 16 of the flexible casing 12. With reference to FIG. 2, there are four fabric panels 14, but other quantities may be suitable. For example, only two fabric panels 14 may be used. Additional layers may be added to provide additional cushioning, for ornamental purposes, and for waterproofing purposes, for example. The fabric panels 14 comprise cotton but may comprise any suitable material such as wool, polyester, vinyl, or the like.

The flexible casing 12 has a first end 18 and a second end 20. The flexible casing 12 also comprises a first end portion 22 adjacent to the first end 18, a second end portion 24 adjacent to the second end 20, and a central portion 26 coupled to and extending between the first end portion 22 and the second end portion 24. The flexible casing 12 is positionable in a planar configuration 28 in which the first end portion 22, the second end portion 24, and the central portion 26 lie on a common plane. The second end portion 24 tapers away from the central portion 26 to the second end 20 of the flexible casing 12.

An insert panel 29 is positioned in the flexible casing 12 between a middlemost pair of fabric panels 15 of the plurality of fabric panels 14. The insert panel 29 comprises a semirigid material such as high-density polymer foam or the like but may comprise a rigid material in other embodiments. The insert panel 29 has a first edge 30 and a second edge 32 positioned opposite each other. The first edge 30 faces the first end 18 of the flexible casing 12 and the second edge 32 faces the second end 20 of the flexible casing 12 when the flexible casing 12 is positioned in the planar configuration 28. The first edge 30 is concavely arcuate.

The flexible casing 12 and the insert panel 29 are positionable in a use configuration 34 wherein the flexible casing 12 forms a U-shape and the insert panel 29 lies horizontally in a base portion of the U-shape. The rigid or semirigid material of the insert panel 29 resists deformation such that the insert panel 29 may remain oriented substantially horizontally in the use configuration 34. Some deflection may occur and is desirable for comfortably cradling a child 54 atop the base portion of the U-shape. The first end portion 22 and the second end portion 24 of the flexible casing 12 form a pair of upright portions of the U-shape when in the use configuration 34, and the central portion 26 of the flexible casing 12 houses the insert panel 29 when in the use configuration 34. The flexible casing 12 also comprises a barrier 27 formed of a stitched thread which is positioned to prevent the insert panel 29 from entering the second end portion 24 of the flexible casing 12. In some embodiments, an additional barrier 27 may be used to secure the insert panel 29 in the central portion 26 of the flexible casing 12. The barrier 27 may also be formed of fabric or other suitable material.

A carrying strap 36 is mounted to the first end 18 of the flexible casing 12 and forms a closed loop with the flexible casing 12. The carrying strap 36 is sized and configured to hang the flexible casing 12 on a shoulder 58 and across a torso 60 of a user 56. The carrying strap 36 is length-adjustable via a slider or other suitable means. In some embodiments, the carrying strap 36 may have two separable portions joined by a buckle or other fastener. A shoulder cushion 38 is mounted to the carrying strap 36 to cushion the shoulder 58 of the user 56 during use.

A retaining fastener 40 is provided which is engageable to retain the flexible casing 12 in the use configuration 34. The retaining fastener 40 comprises a first mating member 42 mounted to the carrying strap 36 and a second mating member 48 mounted to the second end 20 of the flexible casing 12. The first mating member 42 comprises a first connecting strap 44 and a first magnet connector 46, and the second mating member 48 comprises a second connecting strap 50 and a second magnet connector 52. The first magnet connector 46 is releasably couplable to the second magnet connector 52 to retain the flexible casing 12 in the use configuration 34. The first connecting strap 44 is length-adjustable via a slider or other suitable means to position the flexible casing 12 as desired. The first connecting strap 44 is also slidable along the carrying strap 36 and may be kept in any of a variety of desirable positions along the carrying strap 36 via friction or suitable fastener. Other fasteners such as any of a variety of buckles, a hook-and-loop fastener, a tie, or the like may be used in other embodiments.

In use, the child 54 carrier apparatus 10 is worn on the user's 56 shoulder 58 via the carrying strap 36 as described. While being worn, the flexible casing 12 may be positioned in the planar configuration 28 with the flexible casing 12 lying against the user 56. In this manner, the child 54 carrier apparatus 10 may be worn without substantially obstructing an area in front of the user 56. To carry a child 54, such as an infant, the flexible casing 12 and the insert panel 29 are positioned in the use configuration 34 and retained there by the retaining fastener 40. The child 54 is then placed within the U-shape formed by the flexible casing 12 such that the child 54 is supported by the insert panel 29. The first edge 30 of the insert panel 29 rests on the user's 56 torso 60. The first edge 30 is concavely arcuate to conform substantially to the torso 60, thereby providing a comfortable engagement between the torso 60 and the insert panel 29. The second end portion 24 of the flexible casing 12 tapers so that the child 54 is more visible while being carried than if the second end portion 24 did not taper.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A child carrier apparatus comprising:

a flexible casing comprising a plurality of fabric panels, the plurality of fabric panels being layered with each other, the plurality of fabric panels being joined at their peripheral edges to form a perimeter of the flexible casing, the flexible casing having a first end and a second end, the flexible casing comprising a first end portion adjacent to the first end, a second end portion adjacent to the second end, and a central portion coupled to and extending between the first end portion and the second end portion, the flexible casing being positionable in a planar configuration in which the first end portion, the second end portion, and the central portion lie on a common plane;

an insert panel being positioned in the flexible casing, the insert panel having a first edge and a second edge positioned opposite each other, the first edge facing the first end of the flexible casing and the second edge facing the second end of the flexible casing when the flexible casing is positioned in the planar configuration;

wherein the flexible casing and the insert panel are positionable in a use configuration wherein the flexible casing forms a U-shape and the insert panel lies horizontally in a base portion of the U-shape;

a carrying strap mounted to the first end of the flexible casing, the carrying strap being configured to hang the flexible casing on a shoulder and across a torso of a user;

a retaining fastener engageable to retain the flexible casing in the use configuration;

wherein the retaining fastener comprises a first mating member mounted to the carrying strap and a second mating member mounted to the second end of the flexible casing; and wherein the first mating member comprises a first connecting strap and a first magnet connector, the second mating member comprising a second connecting strap and a second magnet connector, the first magnet connector being releasably couplable to the second magnet connector to retain the flexible casing in the use configuration.

2. The apparatus of claim 1, wherein the second end portion of the flexible casing tapers away from the central portion to the second end of the casing.

3. The apparatus of claim 1, wherein the insert panel is positioned between a middlemost pair of fabric panels of the plurality of fabric panels.

4. The apparatus of claim 1, wherein the insert panel comprises a rigid or semirigid material.

5. The apparatus of claim 1, wherein the first edge of the insert panel is concavely arcuate.

6. The apparatus of claim 1, wherein the first end portion and the second end portion of the flexible casing form a pair of upright portions of the U-shape when in the use configuration, the central portion of the flexible casing housing the insert panel when in the use configuration.

7. The apparatus of claim 1, wherein the flexible casing comprises a barrier positioned to prevent the insert panel from entering the second end portion of the casing.

8. The apparatus of claim 1, wherein the carrying strap forms a closed loop with the flexible casing.

9. The apparatus of claim 1, wherein the carrying strap is length-adjustable.

10. The apparatus of claim 1, wherein the first connecting strap is length-adjustable.

11. The apparatus of claim 1, wherein the first connecting strap is slidable along the carrying strap.

12. A child carrier apparatus comprising:

a flexible casing comprising a plurality of fabric panels, the plurality of fabric panels being layered with each other, the plurality of fabric panels being joined at their peripheral edges to form a perimeter of the flexible casing, the flexible casing having a first end and a second end, the flexible casing comprising a first end portion adjacent to the first end, a second end portion adjacent to the second end, and a central portion coupled to and extending between the first end portion and the second end portion, the flexible casing being positionable in a planar configuration in which the first end portion, the second end portion, and the central portion lie on a common plane, the second end portion tapering away from the central portion to the second end of the casing;

an insert panel being positioned in the flexible casing, the insert panel being positioned between a middlemost pair of fabric panels of the plurality of fabric panels, the insert panel comprising a semirigid material, the insert panel having a first edge and a second edge positioned opposite each other, the first edge facing the first end of the flexible casing and the second edge facing the second end of the flexible casing when the flexible casing is positioned in the planar configuration, the first edge being concavely arcuate;

wherein the flexible casing and the insert panel are positionable in a use configuration wherein the flexible casing forms a U-shape and the insert panel lies horizontally in a base portion of the U-shape, the first end portion and the second end portion of the flexible casing forming a pair of upright portions of the U-shape when in the use configuration, the central portion of the flexible casing housing the insert panel when in the use configuration, the flexible casing comprising a barrier positioned to prevent the insert panel from entering the second end portion of the casing;

a carrying strap mounted to the first end of the flexible casing, the carrying strap forming a closed loop with the flexible casing, the carrying strap being sized and configured to hang the flexible casing on a shoulder and across a torso of a user, the carrying strap being length-adjustable; and a retaining fastener engageable to retain the flexible casing in the use configuration, the retaining fastener comprising a first mating member mounted to the carrying strap and a second mating member mounted to the second end of the flexible casing, the first mating member comprising a first connecting strap and a first magnet connector, the second mating member comprising a second connecting strap and a second magnet connector, the first magnet connector being releasably couplable to the second magnet connector to retain the flexible casing in the use configuration, the first connecting strap being length-adjustable, the first connecting strap being slidable along the carrying strap.

* * * * *